US009815316B2

(12) United States Patent
Abe

(10) Patent No.: US 9,815,316 B2
(45) Date of Patent: Nov. 14, 2017

(54) FOUNTAIN PEN NIB

(71) Applicant: AKITA GRIND INDUSTRY CO., LTD., Yuzawa-shi, Akita (JP)

(72) Inventor: Tadao Abe, Yuzawa (JP)

(73) Assignee: AKITA GRIND INDUSTRY CO., LTD., Yuzawa-Shi (JP)

( * ) Notice: Subject to any disclaimer, the term of this patent is extended or adjusted under 35 U.S.C. 154(b) by 0 days.

(21) Appl. No.: 15/322,717

(22) PCT Filed: Mar. 11, 2015

(86) PCT No.: PCT/JP2015/057079
§ 371 (c)(1),
(2) Date: Dec. 28, 2016

(87) PCT Pub. No.: WO2016/006275
PCT Pub. Date: Jan. 14, 2016

(65) Prior Publication Data

US 2017/0136803 A1 May 18, 2017

(30) Foreign Application Priority Data

Jul. 7, 2014 (JP) ..... 2014-139239

(51) Int. Cl.
*B43K 1/00* (2006.01)
*B43K 5/18* (2006.01)

(52) U.S. Cl.
CPC ..... *B43K 5/18* (2013.01); *B43K 1/00* (2013.01); *B43K 1/003* (2013.01)

(58) Field of Classification Search
CPC ..... B43K 1/00; B43K 1/02; B43K 1/003
See application file for complete search history.

(56) References Cited

U.S. PATENT DOCUMENTS 410,272 A * 9/1889 Foster ..... B43K 1/02 15/446
4,474,487 A 10/1984 Malamoud
5,336,010 A * 8/1994 Shiomitsu ..... B43K 5/18 401/199

FOREIGN PATENT DOCUMENTS

GB WO 0064688 A1 * 11/2000 ..... B43K 1/02
JP S75652 Y 5/1932

(Continued)

OTHER PUBLICATIONS

International Search Report (ISR) dated Jun. 23, 2015, issued for International application No. PCT/JP2015/057079.

(Continued)

*Primary Examiner* — Jennifer C Chiang
*Assistant Examiner* — Bradley Oliver
(74) *Attorney, Agent, or Firm* — Law Office of Katsuhiro Arai

(57) ABSTRACT

The present invention uses a material that is not conventionally used in fountain pen nibs in order to provide a fountain pen nib that is completely different from the prior art. This found pen nib comprises one of corundum, topaz, emerald, and garnet as a main material. It is also possible to replace the heart hole and the slit of the nib with a groove that is added to the rear surface of the nib. By using one of the abovementioned gems as the main material in a faun-tain pen nib, it is possible to achieve wear resistance and chemical resistance in the fountain pen nib while imparting a luxurious feel and originality to a fountain pen.

8 Claims, 1 Drawing Sheet

(56) References Cited

FOREIGN PATENT DOCUMENTS

| | | | |
|---|---|---|---|
| JP | 1619284 | Y1 | 12/1941 |
| JP | 4025845 | Y | 9/1965 |
| JP | 57178797 | A | 11/1982 |
| JP | 63242597 | A | 10/1988 |
| JP | 9300876 | A | 11/1997 |
| JP | 10310859 | A | 11/1998 |
| JP | 2003089292 | A | 3/2003 |
| JP | 2010115786 | A | 5/2010 |

OTHER PUBLICATIONS

Notification of Reasons for Refusal issued by Japanese Patent Office, dated Feb. 18, 2016, for counterpart Japanese application No. 2014-139239.

Notification of Transmittal of Translation of the International Preliminary Report on Patentability (PCT/IB/338) dated Jan. 19, 2017, with International Preliminary Report on Patentability (PCT/IB/373) and Written Opinion of the International Searching Authority (PCT/ISA/237), for corresponding international application PCT/JP2015/057079.

* cited by examiner

[FIG. 1]
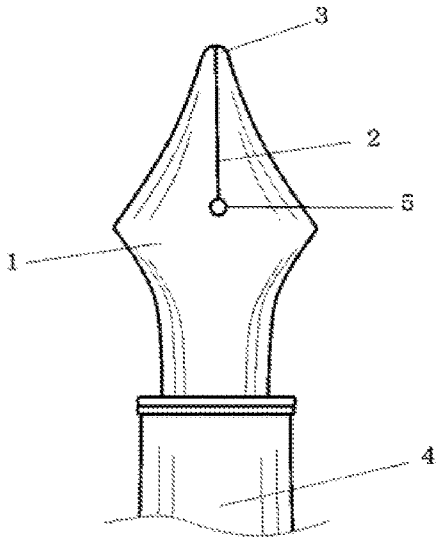
[FIG. 2]
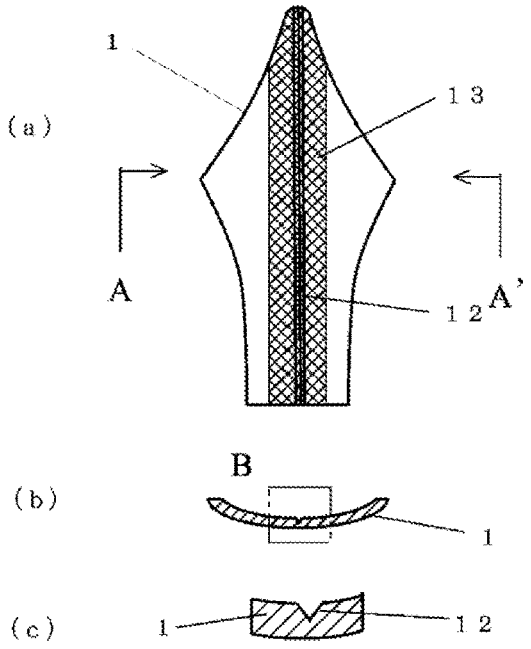

FOUNTAIN PEN NIB

This application is the U.S. National Phase under 35 U.S.C. §371 of International Application PCT/JP2015/057079, filed Mar. 11, 2015, which claims priority to Japanese Patent Application No. 2014-139239, filed Jul. 7, 2014. The International Application was published under PCT Article 21(2) in a language other than English.

TECHNICAL FIELD

The present invention relates to a fountain pen nib. More specifically, the present invention relates to a luxury fountain pen nib using a gem as a main material.

BACKGROUND ART

A fountain pen is constituted by a nib, a pen core, a body, and a cap. Among these components, the nib is a part to write a letter by being in contact with paper, and is the most important part. The nib requires chemical resistance for not being rusted or corroded by an ink, wear resistance for preventing the nib from being worn away due to friction, resistance to friction heat, and smoothness of a tip of the nib allowing the tip to glide on paper smoothly. As a material of the nib, gold or stainless steel is mainly used, and gold is often used for a luxury fountain pen nib. Gold has excellent acid resistance, but has such disadvantages as easily wearing away, difficulty of processing for smoothening a tip of a nib. Therefore, a material having wear resistance, such as iridosmine is welded to a nib to improve wear resistance, and the obtained product is often used as a nib (Patent Literature 1). However, a manufacturing process becomes complicated, and a problem occurs also in design.

CITATION LIST

Patent Literature

Patent Literature 1: JP 2003-89292 A

SUMMARY OF INVENTION

Technical Problem

An object of the present invention is to provide a fountain pen nib completely different from a conventional fountain pen nib using a material not used in a conventional fountain pen nib and to provide a fountain pen nib not causing a problem in wear resistance, design, or the like in a case of using a gold material for a nib.

Solution to Problem

The present inventors made intensive studies, have found that a gem such as sapphire glass or ruby which is single crystal corundum is suitable as a material of a fountain pen nib, and have conceived of solving the above problems.

In addition, it has been found that when sapphire glass, ruby, or the like is actually used as a nib, such disadvantages may occur as repelling ink, difficulty in writing a letter and a blurring in letters. However, it has been found that the above problems are solved by coating a nib at least with a material having higher hydrophilicity than a main material of a fountain pen nib. However, it has been found that hydrophilic coating may be peeled off after long-term use thereof due to an influence of an ink. Therefore, the present inventors made additional studies, have developed a new means for providing hydrophilicity, have developed ink supply means having a completely novel mechanism in place of a slit, and have reached the present invention.

That is, the present invention is as follows.

1. A fountain pen nib comprising one of corundum, topaz, emerald, and garnet as a main material.
2. The fountain pen nib according to above 1, wherein a tip of the nib is smooth.
3. The fountain pen nib according to above 1 or 2, wherein at least a surface of a slit of the nib, to which an ink flows from a pen core is coated with a coating agent having higher hydrophilicity than the main material of the fountain pen nib.
4. The nib according to above 1, including no slit or heart hole, wherein a linear groove is formed longitudinally in a center inside of the nib.
5. The nib according to any one of above 1 to 4, wherein at least the surface of the slit of the nib, to which an ink flows from the pen core or the linear groove and surrounding thereof have been subjected to a surface-roughening treatment.
6. The nib according to above 5, in which the surface-roughening treatment is performed by a laser.
7. A fountain pen comprising the fountain pen nib according to any one of above 1 to 6.

Advantageous Effects of Invention

The nib of the present invention is hard, has wear resistance, is hardly worn away even after long-term use, and is hardly corroded by an ink due to chemical resistance. In addition, the nib has high heat resistance and excellent thermal conductivity, so that hardly broken by friction heat. In addition, a gem gives a luxury feeling, and has not been used as a material of a fountain pen nib conventionally. Therefore, the gem can give a luxury feeling and novelty to a fountain pen.

When gold is used as a material of the nib, it is necessary to weld a hard metal such as iridosmine to a tip of the nib in order to prevent the nib from being worn away or cause the nib to glide on paper smoothly. However, use of a gem does not require such welding, allows a manufacturing process to be simplified, and improves design.

In addition, by forming a linear groove inside the nib and forming surrounding thereof into a rough surface by a laser treatment, wetting by ink can be improved, and a letter is not blurred even after long-term use.

BRIEF DESCRIPTION OF DRAWINGS

FIG. 1 shows a fountain pen nib using sapphire glass as a main material.

FIGS. 2(*a*) to 2(*c*) show a fountain pen nib using sapphire glass as a main material, having a cross section V-shaped linear groove formed inside thereof.

DESCRIPTION OF EMBODIMENTS

Hereinafter, the present invention will be described in detail.

A main material of the fountain pen nib of the present invention is corundum including sapphire glass and ruby, topaz, emerald, or garnet, preferably corundum including sapphire glass and ruby, and more preferably sapphire glass. The main material may be a natural product or a synthetic product, and may be a single crystal or a polycrystal, but is preferably a single crystal. As seen from a fact that sapphire glass or ruby is used for a bearing of a watch, these gems are hard and have wear resistance, and therefore are hardly worn away even after long-term use for a fountain pen nib. In addition, these gems have chemical resistance, and therefore are hardly corroded by an ink, and use thereof for a nib allows a fountain pen to be used for a long time.

In addition, these gems give a luxury feeling, and have not been used as a material of a fountain pen nib conventionally. Therefore, these gems can give a luxury feeling and novelty to a fountain pen. For example, use of sapphire glass for the nib makes the nib transparent, and a stereotype that a luxury fountain pen nib has a gold color can be overturned.

The shape of a tip of the nib is not particularly limited, but requires to be smooth. For example, the shape of the tip may be a plate shape having a smooth corner. In addition, the tip may be processed into a spherical crown shape, a spherical shape, or the like. By processing the tip of the nib into such a shape, the nib glides on paper smoothly, and a writing feeling is improved.

The shape of the nib may be similar to that of a conventional nib. The nib is usually curved inside in an arc shape. In this case, when a curvature radius R thereof is large, the nib repels an aqueous ink, that is, a capillary phenomenon hardly acts, the ink hardly penetrates into a slit of the nib, and the ink may be solidified disadvantageously. Therefore, by reducing the R or coating the nib at least with a material having higher hydrophilicity than a main material of the fountain pen nib, for example, with magnesium fluoride used as a non-reflection coating agent in a case of using sapphire glass as the main material, penetration of an ink into a slit of the nib is promoted, and an ink can be prevented from being repelled and solidified. R is preferably 20 mm or less, and more preferably from 5 to 15 mm. The curvature radius may be equal over the nib, or may be slightly larger as closer to the tip. Noted that it is not always necessary for the curvature to have a perfect arc shape.

Coating of the nib can be performed by a known method such as vacuum deposition, sputtering, or CVD. Coating may be performed on the entire nib, but may be performed on the entire nib except for a tip of the nib, only on surrounding of a slit of the nib, or only on a surface of the slit of the nib, to which an ink flows from a pen core.

The width of the slit of the nib is preferably 0.2 mm or less, and more preferably 0.1 mm or less. It is possible to write a finer letter with a narrower width.

The fountain pen nib of the present invention is manufactured by polishing a gem as a main material. For example, a case where sapphire glass is used as the main material will be described below.

From so-called plano-convex cylindrical type sapphire glass having a semi-cylindrical shape, the gem is sliced such that the thickness of the material, the vertical length thereof, and the horizontal length thereof are appropriate to obtain an appropriate size. The gem is sliced so as to have a so-called nib shape which is thinner toward a tip. Furthermore, front and back surfaces of the semi-cylindrical shape are sliced such that the nib is curved in an arc shape. A slit is formed in the nib, an outer periphery is subjected to chamfering, brushing is performed, and the outer periphery is polished finally. When sapphire is sliced, each surface thereof is sliced, and an uneven portion is polished to give a luxury feeling.

As described above, the nib of sapphire glass, ruby, or the like, which has been subjected to hydrophilic coating has unprecedented durability and wear resistance, and gives a luxury feeling. However, it has been found that the hydrophilic coating is deteriorated by an ink, hydrophilicity is lowered, and discoloration or blurring in letters may occur after long-term use of the nib. Therefore, the present inventors made further studies, and have found that hydrophilicity is improved by performing a surface-roughening treatment (so-called satin finish) in place of the hydrophilic coating. By a rough surface, water repellency is suppressed, the nib is easily wetted, an ink easily flows to the tip, and blurring no longer occurs.

Furthermore, the present inventors have found that an ink flows smoothly to the tip even after long-term use, and blurring or the like does not occur by forming a thin groove inside the nib in place of a heart hole and a slit which have been usually formed in a conventional nib and subjecting the groove and surrounding thereof to a surface-roughening treatment by a laser.

The groove is formed longitudinally and almost linearly on a backside (inside an arc) of the nib. The groove may be formed over the entire length of the nib from a root to a tip, or may be formed from almost the center in a longitudinal direction of the nib (part in which a heart hole is conventionally formed) to the tip of the nib. The depth of the groove depends on the thickness of the nib, but is usually from 0.1 to 0.3 mm, preferably from 0.15 to 0.25 mm, and particularly preferably about 0.2 mmm. The width of the groove on a front surface of the nib is from 0.1 to 0.3 mm, preferably from 0.15 to 0.25 mm, and particularly preferably from 0.2 to 0.22 mm. The cross-sectional shape of the groove is not particularly limited, but is usually a V-shape, a semicircular shape, a semi-elliptical shape, or the like.

An inside of the groove and surrounding thereof are preferably formed into fine rough surfaces, that is, satin surfaces by laser processing or the like. In a similar manner to the above, by a rough surface, water repellency is suppressed, the nib is easily wetted, an ink easily flows to the tip, and blurring no longer occurs. The surface-roughening treatment is preferably performed by a laser, but may be performed by another method such as a sandblasting method.

In addition, as a collateral effect, an ink hardly oozes on a front side of the nib, and ink contamination does not occur because a heart hole or a slit is not necessary.

In addition, by performing a surface-roughening treatment by a laser, retention of an ink is improved, and therefore dripping of the ink from the nib hardly occurs. Utilizing the improvement of retention, By adjusting a pressure applied to the ink, the amount of the ink can be adjusted, and the thickness of a letter can be adjusted.

A groove is usually formed on a backside of nib with a diamond cutter. A desired cross-sectional shape can be formed according to an edge shape of the cutter. For example, a V-shaped groove can be easily carved with a rotary blade having an acute angle edge. To form a conventional slit, cutting needs to be performed with an extremely thin cutter to cause blade chipping or the like, and therefore an advanced technology is necessary. In contrast, in order to carve a groove, it is not necessary to make the entire cutter thin, and therefore processing is easy. In a case of the slit, an extremely thin nib tip makes its strength weak, there is a limit to the thickness of the nib tip, and it is difficult to manufacture a nib to write an extremely thin letter. However, in a case of the V-groove, the tip is not split, therefore much thinner processing can be performed than in the case of the slit, and the V-groove is also suitable for manufacturing a nib for writing an extremely thin letter.

EXAMPLES

Hereinafter, the present invention will be described based on the drawings and Examples.

Example 1

FIG. 1 shows a front side of a nib in an Example of a fountain pen nib of the present invention using sapphire glass. The sign 1 represents the nib, the sign 2 represents a slit, the sign 3 represents a tip, the sign 4 represents a body of a fountain pen, and the sign 5 represents a heart hole. The nib is curved toward a backside of the drawing. The tip of the nib 3 has a smoothly polished plate shape having an almost semi-circular shape in a top view. Surrounding of the slit except for the tip 3 is coated with magnesium fluoride.

When a fountain pen was manufactured using this nib according to a usual manner, was subjected to a writing test, and was compared with a conventionally commercially available fountain pen using an 18-karat gold nib, a so-called writing feeling was equal to each other. The fountain pen of the present invention gave an extremely luxury feeling.

Example 2

FIGS. 2(*a*) to 2(*c*) show a nib, having a cross section V-shaped groove formed on a backside of the nib in place of the slit and the heart hole in FIG. 1. FIG. 2(*a*) is a diagram of the backside. FIG. 2(*b*) is an arrow cross-sectional diagram cut along A-A'. FIG. 2(*c*) is an enlarged diagram of the B portion. A groove 12 having a cross-sectional V shape is linearly formed from a root to a tip on the backside of the nib.

A fountain pen was manufactured using this nib according to a usual manner, was subjected to a writing test, and was compared with Example 1. As a result, a writing feeling was equal to Example 1.

Example 3

A durability test was performed using the nib in Example 2.

A copy paper was wound around a disk-shaped metal rotation rotor having a diameter of 178 mm. While a nib was pressed against the roller at a contact angle of about 45 degrees, rotation was performed at 3.4 rpm, and the wear degree of the nib was observed. After 100 hours, the nib was observed, and worn of the nib was hardly observed. This nib was subjected to a writing test again, and a writing feeling was equal to that at the beginning.

Example 4

A test similar to Example 3 was performed using a wood rotation roller while a nib was pressed directly against the roller. The rotation speed was 1.7 rpm. After 48 hours, the nib was observed, and worn of the nib was hardly observed.

Example 5

A test similar to Example 4 was performed using a metal roller while a nib was pressed directly against the roller. The rotation speed was 1.7 rpm. After 24 hours, the nib was observed, and worn of the nib was hardly observed.

INDUSTRIAL APPLICABILITY

The fountain pen nib of the present invention is useful particularly as a luxury fountain pen nib.

REFERENCE SIGNS LIST

1: nib
2: slit
3: tip of nib
4: body of fountain pen
5: heart hole
12: groove
13: rough surface

The invention claimed is:

1. A fountain pen nib, the whole of which including a tip of the nib is constituted by a polished natural or synthetic gemstone which is one of corundum, topaz, emerald, and garnet as a main material, wherein the pen nib has no slit or breather hole and a linear groove is formed longitudinally in a center of an inner side of the nib.

2. The nib according to claim 1, wherein at least the linear groove and surroundings thereof are surface-roughening treated.

3. The nib according to claim 2, wherein the roughening treated surface is a laser-roughening treated surface.

4. A fountain pen comprising the fountain pen nib according to claim 3.

5. A fountain pen comprising the fountain pen nib according to claim 2.

6. A fountain pen comprising the fountain pen nib according to claim 1.

7. The nib according to claim 1, wherein the nib is coated with a material having higher hydrophilicity than that of the main material.

8. A fountain pen comprising the fountain pen nib according to claim 7.

* * * * *